US005607202A

United States Patent [19]

Toso et al.

[11] Patent Number: 5,607,202

[45] Date of Patent: Mar. 4, 1997

[54] COLLAPSIBLE BACK SUPPORT

[76] Inventors: Victor Toso, 771 NE. Harding St., Minneapolis, Minn. 55413; Jack K. Hockenberry, 1442 Martin Rd., Albert Lea, Minn. 56007

[21] Appl. No.: 488,732

[22] Filed: Jun. 8, 1995

[51] Int. Cl.[6] ..... A47C 4/00

[52] U.S. Cl. ..... 297/44; 297/350

[58] Field of Search ..... 297/44, 350, 440.21, 297/440.2, 284.4

[56] References Cited

U.S. PATENT DOCUMENTS

| | | | |
|---|---|---|---|
| 633,012 | 9/1899 | Depue | 297/350 |
| 3,142,351 | 7/1964 | Green | 297/44 X |
| 4,240,663 | 12/1980 | Locher | 297/440.21 X |
| 4,545,614 | 10/1985 | Abu-Isa et al. | 297/440.2 X |
| 4,925,242 | 5/1990 | Harris et al. | 297/284.4 |
| 5,244,222 | 9/1993 | Benoit | 297/44 X |
| 5,308,147 | 5/1994 | Tseng | 297/440.2 X |

FOREIGN PATENT DOCUMENTS

| | | | |
|---|---|---|---|
| 621843 | 2/1927 | France | 297/44 |
| 1186413 | 8/1959 | France | 297/284.4 |
| 587924 | 1/1978 | U.S.S.R. | 297/284.4 |

*Primary Examiner*—Peter R. Brown
*Assistant Examiner*—David E. Allred
*Attorney, Agent, or Firm*—Aquilino & Welsh

[57] ABSTRACT

A back support for use with a collapsible body support. The back support includes at least one first rib having a first end, a second end, and a central portion between the first end and the second end, wherein the first end includes structure for pivotally securing the at least one first rib to a first support member. The back support further includes at least one second rib having a first end, a second end, and a central portion between the first end and the second end, wherein the first end includes structure for pivotally securing the at least one second rib to a second support member. The central portion of the at least one first rib is pivotally connected to the central portion of the at least one second rib to form a support surface upon which an individual can rest their back.

20 Claims, 3 Drawing Sheets

COLLAPSIBLE BACK SUPPORT

BACKGROUND OF THE INVENTION

1. Field of the Invention

The invention relates to collapsible back supports. More particularly, the invention relates to a collapsible back support for use with wheelchairs, wherein the back support includes a unique cross construction forcing an individual to sit in an upright position.

2. Background of the Invention

Back supports provided with wheelchairs must be collapsible to permit folding and storage of the wheelchair when the chair is not in use. Currently, wheelchair back supports are manufactured from a flexible sheet of material, hammock, secured between a pair of upwardly extending support posts at the rear of the wheelchair. While these back supports are flexible, thus permitting an individual to readily fold the chair, they fail to provide the back support needed by individuals confined to a wheelchair for a prolonged period of time. In fact, these back supports encourage bad posture resulting in the discomfort caused by lower back problems.

In fact, there is a growing consensus among health-care practitioners that poor posture is a leading cause of the illness and disease related to back problems and pressure sores. Improper posture can actually rupture discs, and practitioners have stated that poor sitting posture is one of the major factors, and definitely the most ignored factor, in the etiology of pressure sores.

The design of back supports is one of the leading causes of back problems, especially in the case of wheelchairs. Because of the need for collapsibility, wheelchairs are typically constructed with vinyl or fabric hammocks seats and back rests. Even under the most ideal circumstance, i.e., when these fabrics are stretched tightly across the support members, the weight of the user will cause the fabric to stretch over time. As a result, pressures on the body are distributed unevenly causing the body to sit obliquely. Eventually, what begins as sitting discomfort due to slouching, eventually leads to the development of pressure sores and herniated discs.

These problems can be solved by providing a support surface capable of supporting normal lordosis in the lumbar spine. This is achieved by keeping the pelvis rotated forward. In fact, it has been shown that eight times more intradiscal pressure is created when a person assumes a kyphotic, or backward (i.e., slouching), sitting posture. Further, when an individual slouches the center of gravity rides behind the pelvis and the sitting bones do not take the direct pressure of sitting. Instead there is a sheering force against the sitting bones and occasionally even pressure on the tailbone and sacrum when the pelvis has rolled back. These uneven pressures often lead to pressure sores in wheelchair users.

Similar problems occur in conventional chairs utilizing straight backs as a support for a seated individual's back. Many straight back seats inherently encourage individuals to slouch, resulting in bad posture and lower back pain. This problem is exaggerated in collapsible chairs when the back support must be collapsible to accommodate the collapsing mechanism used by the chair. As with wheelchairs, such collapsible chairs often utilize flexible sheets secured between the upstanding support posts extending from the seat member. These flexible sheets do not provide the back support necessary to ensure proper posture.

In view of the shortcomings of back supports currently available, there continues to be a need for an adjustable back support providing the support required by individuals who must be in a seated position for extended periods of time. The present invention overcomes the shortcomings of prior back supports by providing a stable, collapsible, and adjustable back support for use with collapsible wheelchairs, or other collapsible chairs.

SUMMARY OF THE INVENTION

The present invention is directed to a back support for use with a collapsible body support, e.g., wheelchair, chair, etc. The back support includes at least one first rib having a first end, a second end, and a central portion between the first end and the second end, wherein the first end includes means for pivotally securing the at least one first rib to a first support member of a body support. The back support further includes at least one second rib having a first end, a second end, and a central portion between the first end and the second end, wherein the first end includes means for pivotally securing the at least one second rib to a second support member of a body support. The central portion of the at least one first rib is pivotally connected to the central portion of the at least one second rib to form a support surface upon which an individual can rest their back.

With the foregoing back support in mind, it is an object of the present invention to provide a back support that may be used in conjunction with a collapsible chair, especially a collapsible wheelchair.

It is also an object of the present invention to provide an adjustable lumbar support which maintains lumbar lordosis.

Another object is the provision of a back support wherein a plurality of ribs are pivotally connected to the first support member and a plurality of ribs are pivotally connected to the second support member.

A further object of the present invention is to provide a back support wherein the plurality of ribs pivotally connected to the first support member are alternately connected to the plurality of ribs pivotally connected to the second support member.

It is also an object of the present invention to provide a back support wherein the at least one first rib and the at least one second rib each have a longitudinal axis, and the shape of the at least one first rib and the shape of the at least one second rib are uniform along their longitudinal axis.

Another object of the present invention is to provide a back support including a first mounting bracket for pivotally connecting the at least one first rib to the first support member and a second mounting bracket for pivotally connecting the at least one second rib to the second support member.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
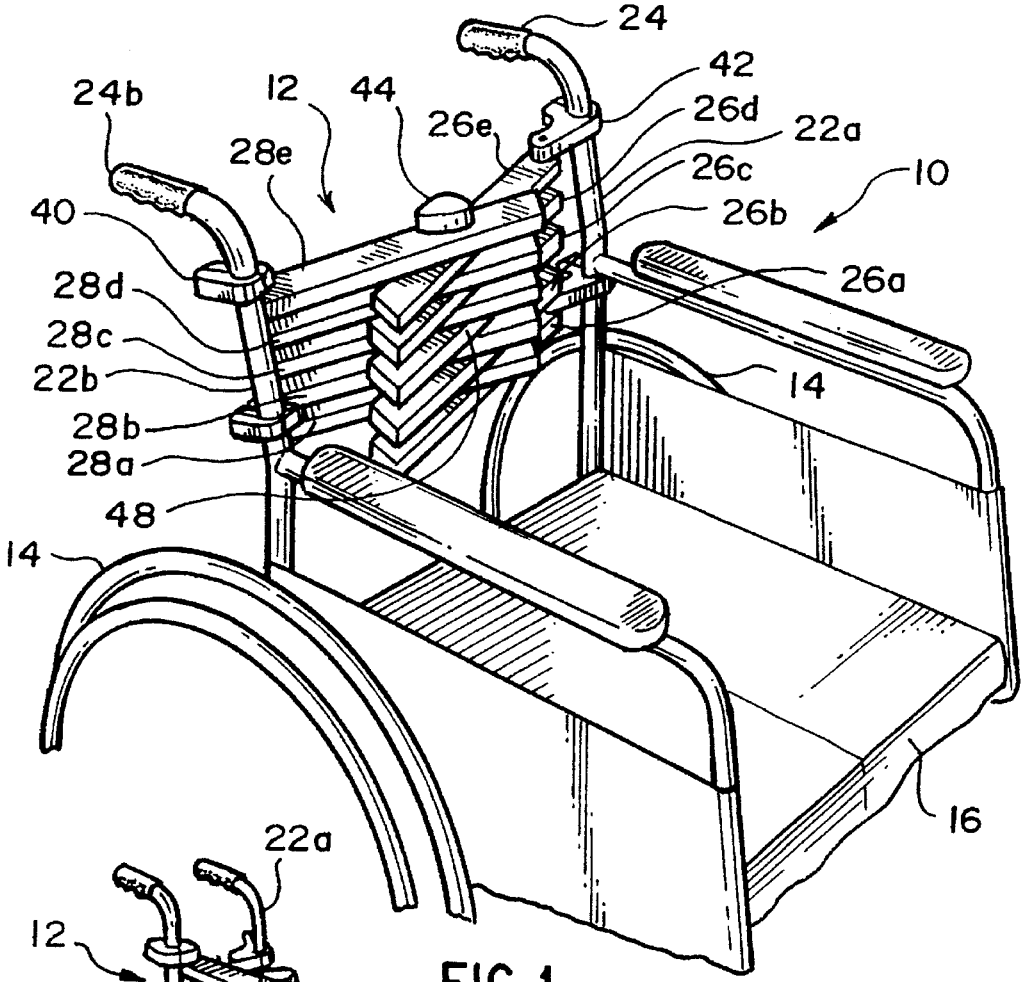
FIG. 1 is a perspective view of a wheelchair utilizing the back support of the present invention.

With reference to FIG. 1, a wheelchair 10 incorporating the present back support 12 is shown. With the exception of the back support 12, the wheelchair 10 is a conventional wheelchair and includes a pair of wheels 14 supporting a seat member 16 and leg supports 18. A pair of guide wheels 20 are respectively secured at the ends of the leg supports 18. A pair of support posts 22*a*, 22*b* extend vertically from the base of the seat member 16 and end as rearwardly oriented handles 24*a*, 24*b* which an individual may grip while pushing the wheelchair 10. The present back support 12 is secured between the support posts 22*a*, 22*b*.

The back support 12 includes a first set of five ribs 26*a*, 26*b*, 26*c*, 26*d*, 26*e* pivotally secured to the first support post 22*a* and a second set of five ribs 28*a*, 28*b*, 28*c*, 28*d*, 28*e* pivotally secured to the second support post 22*b*. Each rib includes a proximal end 34*a*, 34*b* secured adjacent the respective support post 22*a*, 22*b*, a central portion 36*a*, 36*b* secured to the central portion 36*a*, 36*b* of ribs attached to the opposing support post, and a distal end 38*a*, 38*b* extending beyond the central portions 36*a*, 36*b*. While five ribs are disclosed in the preferred embodiment, any number of ribs may be used without departing from the spirit of the present invention so long as the user's comfort is maintained.

Figure 4:
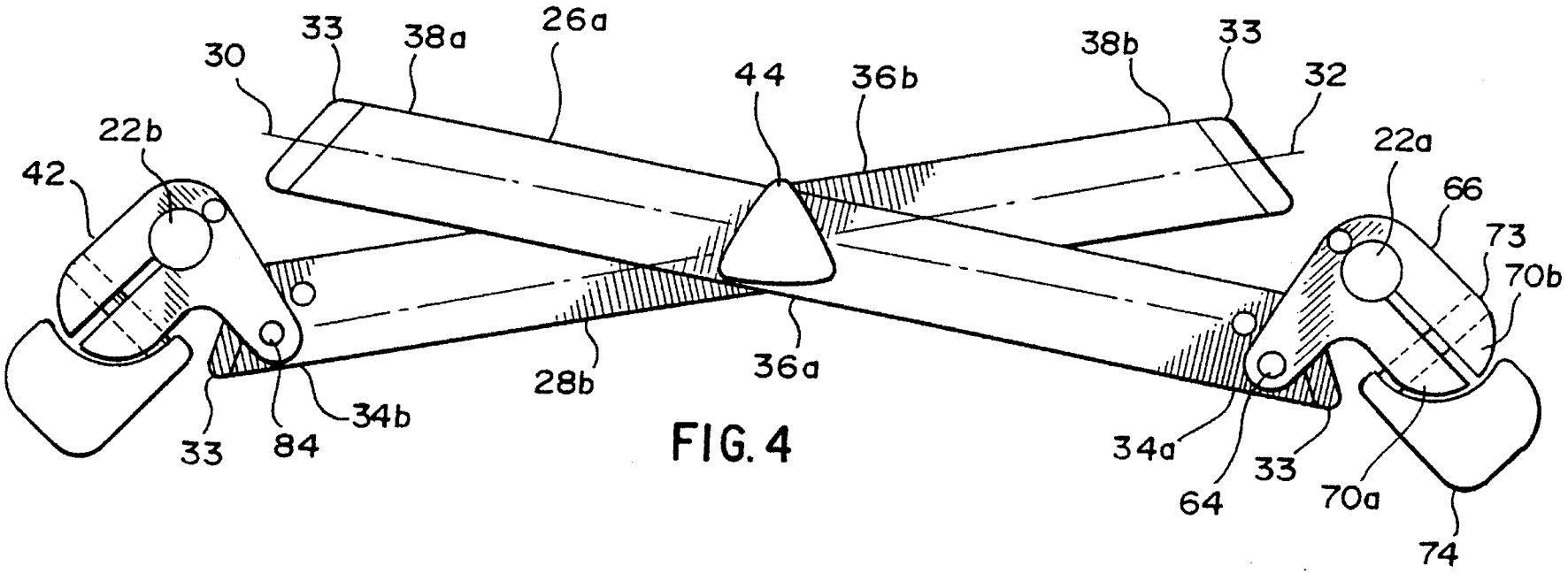
FIG. 4 is a bottom view of the back support.

With reference to FIG. 4, each rib (ribs 26*a* and 28*a* are shown) includes a longitudinal axis 30, 32, wherein the shape of the rib is substantially identical along the longitudinal axis. All of the ribs secured to a support post are the same shape and the ribs secured to the opposing support post are mirror images of the other set of ribs. The ribs are preferably manufactured from extruded polyvinylchloride (PVC) and include rubber end caps 33 secured to each end of the rib. The rib 28b shown in FIG. 4 is part of the second set of ribs and is designed to be secured to the second support post 22*b* in a manner that will be discussed below. The rib 28*b* includes a proximal end 34*b* having a hole therein, a central portion 36*b* having a hole therein, and a distal end 38*b*. Similarly, rib 26*a* is pivotally secured to the first support post 22*a* and includes a proximal end 34*a* having a hole therein, a central portion 36*a* having a hole therein and a distal end 38*a*. While the preferred embodiment includes ribs having a consistent shape along their longitudinal axis, the ribs may take a variety of shapes without departing from the spirit of the present invention. Additionally, the ribs may be manufactured from any suitable material without departing from the spirit of the invention.

As stated previously, the first set of ribs 26*a–e* extend from the first support post 22*a* and the second set of ribs 28*a–e* extend from the second support post 22*b*. The proximal end 34*a* of each rib included in the first set of ribs 26*a–e* is pivotally secured to a first mounting bracket 40 attached to the first support post 22*a*. Similarly, the proximal end 34*b* of each rib included in the second set of ribs 28*a–e* is pivotally secured to a second mounting bracket 42 attached to the second support post 22*a*. The ribs are spaced apart approximately the width of a rib, thus permitting another rib to fit between two ribs adjacently mounted on the same mounting bracket.

The central portions 36*a* of the ribs included in the first set of ribs 26*a–e* are pivotally secured to the central portions 36*b* of the ribs included in the second set of ribs 28*a–e*. This is accomplished by alternately positioning the central portion 36*a* of a rib from the first set of ribs 26*a–e* between adjacent ribs on the second set of ribs 28*a–e*. The central portions 36*a* of the first set of ribs 26*a–e* and the central portions 36*b* of the second set of ribs 28*a–e* are pivotally secured together by a central pivot post 44 passing through aligned holes 46*a*, 46*b* in the central portions 36*a*, 36*b* of the ribs.

The distal ends 38*a*, 38*b* of the ribs extend beyond the pivotal connection between the first set of ribs 26*a–e* and the second set of ribs 28*a–e*. This creates a generally V-shaped surface 48 which supports an individual's back when seated in the wheel chair, or any other chair to which the back support might be attached. The V-shaped surface 48 prevents an individual from slouching while seated in the chair and forces the individual to sit upright. The comfort of the back support may be enhanced by providing cushioning on the surface of the ribs directly contacting an individual's back.

As stated previously, the proximal ends 34*a*, 34*b* of the first set of ribs 26*a–e* and the second set of ribs 28*a–e* are pivotally and releasably secured to the first support post 22*a* and the second support post 22*b*, respectively, by mounting brackets 40, 42. Each mounting bracket includes a top fixed bracket which is secured to the support post adjacent the handles and a bottom pivot bracket secured to the support post adjacent the lower end of the support post. Each mounting bracket further includes a pivot post connected between the top fixed bracket and the bottom pivot bracket. The pivot posts support the proximal ends of the ribs for pivotal movement.

Figure 3:
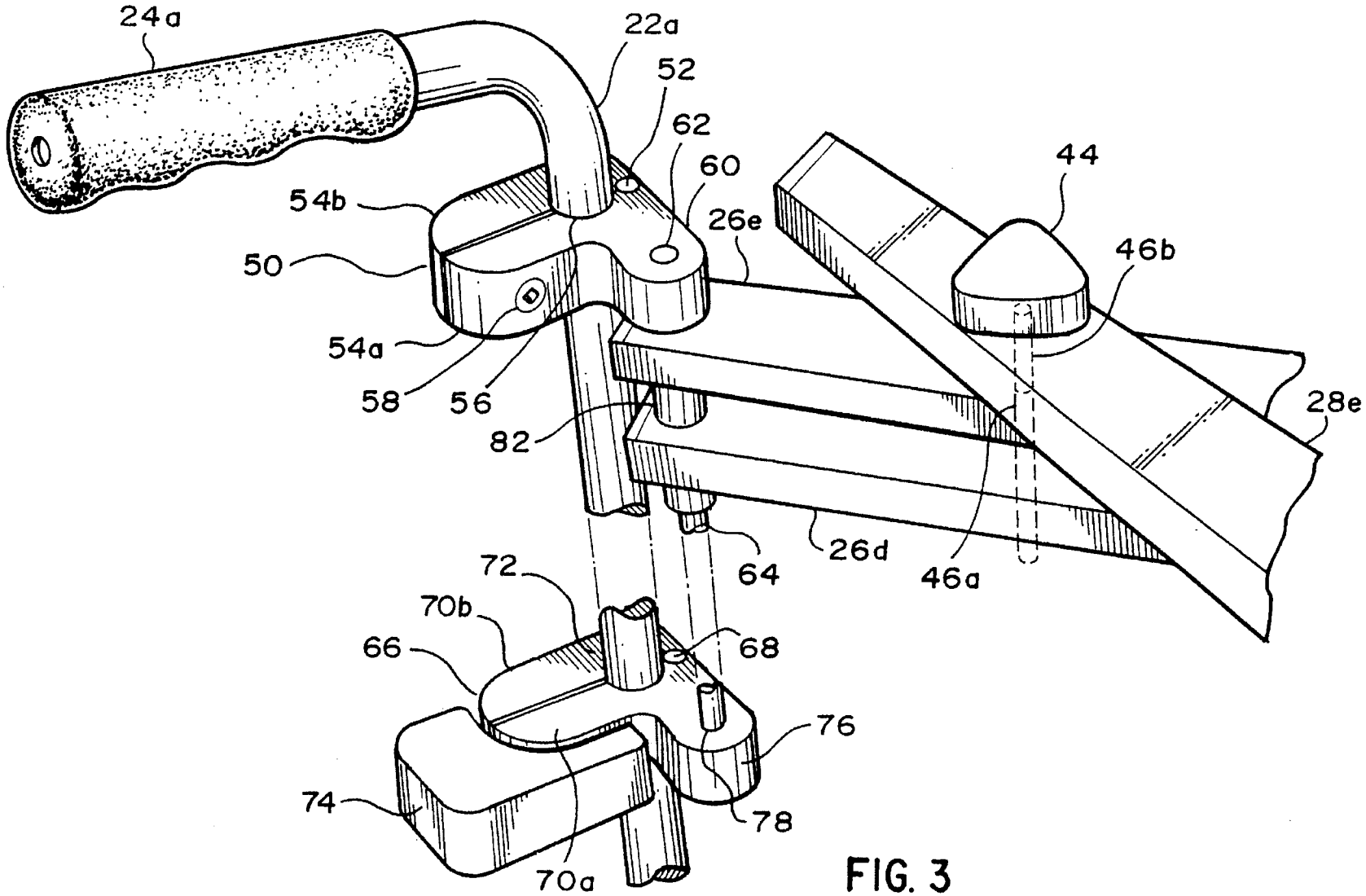
FIG. 3 is a detailed view of the mounting bracket.

With reference to FIG. 3, the first mounting bracket 40 is shown in detail. The second mounting bracket 42 is identical to the first mounting bracket 40 with the exception that it is a mirror image of the first mounting bracket 40. The top fixed bracket 50 is a generally U-shaped member. The top fixed bracket 50 includes a hinge 52 at the closed end permitting the legs 54*a*, 54*b* of the top fixed bracket 50 to be selectively drawn together so that a central opening 56 may engage the first support post 22*a* . The hinge used in the preferred embodiment is a conventional post-type hinge, although other hinges could be used without departing from the spirit of the invention (e.g. living hinge). The central opening 56 is sized to be securely clamped to the first support post 22*a*. The leg 54*a* of the top fixed bracket 50 includes a bore through which a screw 58 passes and the leg 54*b* of the top fixed bracket includes a threaded bore through which a screw 58 is passed to drawn the legs 54*a*, 54*b* together and releasably clamp the top fixed bracket 50 to the first support post 22*a* . In use, the top fixed bracket 50 may be selectively secured to and removed from the first support post 22*a* by screwing or unscrewing the legs 54*a*, 54*b* together. The top fixed bracket 50 also includes a flange 60 having an opening 62 in which the top of the first pivot post 64 is secured.

The bottom pivot bracket 66 is similar to the top fixed bracket 50 and includes a hinge 68 at the closed end permitting the legs 70*a*, 70*b* of the bottom pivot bracket 66 to be drawn together so that the central opening 72 may engage the first support post 22*a* . The central opening 72 is sized to be securely clamped to the first support post 22*a* . The leg 70*a* of the bottom pivot bracket 66 includes a bore through which a screw 73 passes and the leg 70*b* of the bottom pivot bracket 66 each includes a threaded bore through which a screw 73 is passed to selectively draw the legs 70*a*, 70*b* together and clamp the pivot bracket 66 to the first support post 22*a* . A lever 74 is releasably secured to the screw 73 (e.g., by another screw) permitting an individual to readily release the pressure applied by the screw 73 and allow the individual to pivot the bracket 66 on the support post 22*a* , thereby adjusting the shape and position of the back support 12. This is accomplished by rotating the lever 74 which rotates the screw 73 to release the pressure holding the bracket in place. The screw has "cork screw" like threading to permit a small rotation to release pressure on the support post 22*a* . Specifically, the bottom pivot bracket 66 may be rotated to adjust the lumbar support provided by the back support 12. As should be apparent with reference to the drawings, rotation of the bottom pivot bracket 66 will either force the ribs outwardly to create additional lumbar support or force the ribs rearwardly to limit the lumbar support. The bottom pivot bracket 66 also includes a flange 76 having an opening 78 in which the bottom of the first pivot post 64 is secured.

The proximal ends 34a of the first set of ribs 26*a–e* are pivotally secured to the first pivot post 64 of the first mounting bracket 40 by passing the first pivot post 64 through aligned holes in the proximal ends 34*a* of the ribs. Similarly, the proximal ends 34*b* of the second set of ribs 28*a–e* are pivotally secured to the second pivot post 84 of the second mounting bracket 42 by passing the second pivot post 84 through aligned holes in the proximal ends 34*b* of the ribs. As stated previously, adjacent ribs are spaced approximately the width of a rib, permitting an opposing rib to be positioned between adjacent ribs. The ribs are maintained in a spaced relation by bushings 82 positioned between adjacent ribs.

Figure 2:
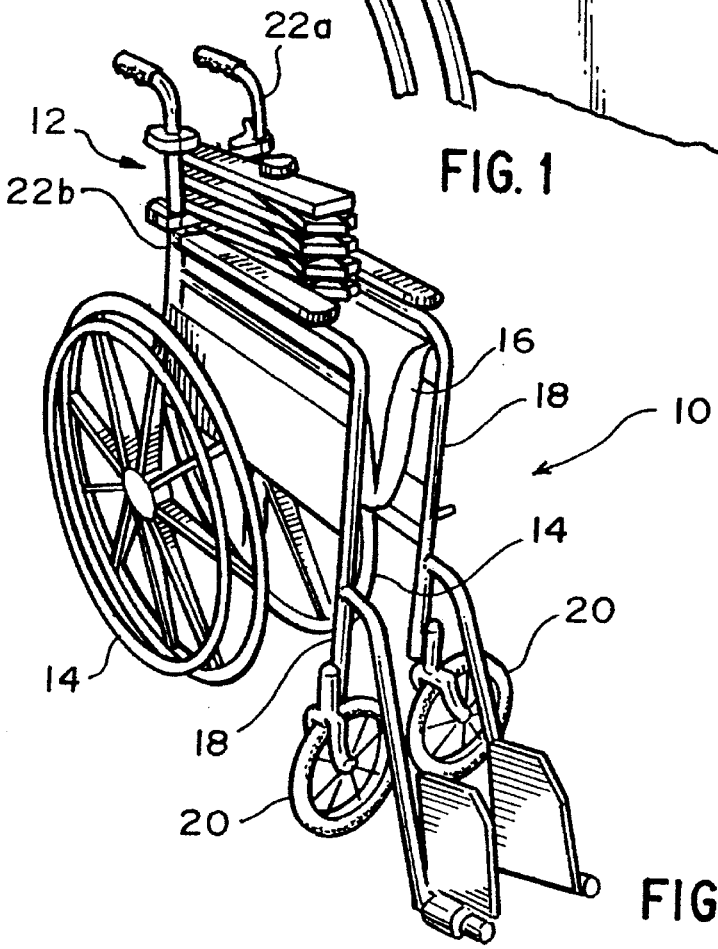
FIG. 2 is a perspective view of the wheelchair shown in FIG. 1 in its collapsed configuration.

When the back support 12 is properly secured to the wheelchair 10, the back support 12 will collapse when an individual collapses the wheelchair 10 itself. With reference to FIG. 1, the back support is secured to a wheelchair 10, opened to support an individual. The mounting brackets 40, 42 are positioned a distance from each other and the ribs extend to form a v-shaped support 48 for the back of an individual. With reference to FIG. 2, the collapsed wheelchair is shown. The mounting brackets 40, 42 are positioned adjacent to each other and the ribs have pivoted on the pivot posts 64, 84 and the central pivot post 44 such that the ribs are substantially folded together.

While the present back support has been disclosed for use with a wheel chair, the present back support could be used in conjunction with any type of seat requiring a back support that collapses. For example, the back support could be secured to a conventional collapsible chair. The back support would be secured to the two upstanding support posts of the chair in the same manner the back support is secured to the wheelchair discussed above.

Although the preferred embodiment discloses the present invention used as a back support on a wheelchair, it may be possible to use the present invention as a general support. For example, the present invention could be used as seat support without departing from the spirit of the present invention.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A collapsible body support moveable between a first collapsed position and a second fully expanded position, including a seat member, a first support member and a second support member extending from said seat member, and a back support releasably secured between said first support member and said second support member, said back support comprising:

at least one first rib extending from said first support member, said at least one first rib having a first end, a second end, and a central portion between said first end and said second end, wherein said first end of said at least one first rib is pivotally connected to said first support member;

at least one second rib extending from said second support member, said at least one second rib having a first end, a second end, and a central portion between said first end and said second end, wherein said first end of said at least one second rib is pivotally connected to said second support member; and wherein said central portion of said at least one first rib is pivotally connected to said central portion of said at least one second rib to form a V-shaped support surface, created by said second end of said at least one first rib and said second end of said at least one second rib when said body support is in its second fully expanded position, upon which an individual can rest their back.

2. The body support according to claim 1, wherein a plurality of ribs are pivotally connected to said first support member and a plurality of ribs are pivotally connected to said second support member.

3. The body support according to claim 2, wherein said plurality of ribs pivotally connected to said first support member are connected to said plurality of ribs pivotally connected to said second support member.

4. The body support according to claim 1, wherein said at least one first rib and said at least one second rib each have a longitudinal axis, and the shape of said at least one first rib and the shape of said at least one second rib are uniform along their longitudinal axes.

5. The body support according to claim 1, wherein said at least one first rib and said at least one second rib are manufactured from PVC.

6. The body support according to claim 1, further including a first mounting bracket pivotally and releasably connecting said at least one first rib to said first support member and a second mounting bracket pivotally and releasably connecting said at least one second rib to said second support member, said first mounting bracket and said second mounting bracket permitting adjustment of said support surface.

7. The body support according to claim 1, wherein said body support is a chair.

8. The body support according to claim 7, wherein said body support is a wheelchair.

9. A support member for use with a collapsible body support moveable between a first collapsed position and a second fully expanded position, comprising:

at least one first rib having a first end, a second end, and a central portion between said first end and said second end of said at least one first rib, and first means for pivotally securing said first end of said at least one first rib to a first support member;

at least one second rib having a first end, a second end, and a central portion between said first end and said second end of said at least one second rib, and second means for pivotally securing said first end of said at least one second rib to a second support member; and wherein said central portion of said at least one first rib is pivotally connected to said central portion of said at least one second rib to form a V-shaped support surface, created by said second end of said at least one first rib and said second end of said at least one second rib when said body support is in its second fully expanded position, upon which an individual can rest their body.

10. The support member according to claim 9, wherein a plurality of ribs are pivotally connected to said first support member and a plurality of ribs are pivotally connected to said second support member.

11. The support member according to claim 10, wherein said plurality of ribs pivotally connected to said first support member are connected to said plurality of ribs pivotally connected to said second support member.

12. The support member according to claim 9, wherein said at least one first rib and said at least one second rib each have a longitudinal axis, and the shape of said at least one first rib and the shape of said at least one second rib are uniform along their longitudinal axes.

13. The support member according to claim 9, wherein said at least one first rib and said at least one second rib are manufactured from PVC.

14. The support member according to claim 9, wherein said first means for pivotally securing includes a first mounting bracket pivotally and releasably connecting said at least one first rib to said first support member and said second means for pivotally securing includes a second mounting bracket for pivotally and releasably connecting said at least one second rib to said second support member, said first means and said second means permitting adjustment of said support surface.

15. A wheelchair moveable between a first collapsed position and a second fully expanded position, including a pair of wheels having a seat member and a back support secured therebetween, wherein said back support is held between a first upwardly extending support member and a second upwardly extending support member, said back support comprising:

at least one first rib extending from said first support member, said at least one first rib having a first end, a second end, and a central portion between said first end and said second end, wherein said first end of said at least one first rib is pivotally connected to said first support member;

at least one second rib extending from said second support member, said at least one second rib having a first end, a second end, a central portion between said first end and said second end, wherein said first end of said at least one second rib is pivotally connected to said second support member; and wherein said central portion of said at least one first rib is pivotally connected to said central portion of said at least one second rib to form a V-shaped support surface, created by said second end of said at least one first rib and said second end of said at least one second rib when said wheelchair is in its second fully expanded position, upon which an individual can rest their back.

16. The wheelchair according to claim 15, wherein a plurality of ribs are pivotally connected to said first support member and a plurality of ribs are pivotally connected to said second support member.

17. The back support according to claim 16, wherein said plurality of ribs pivotally connected to said first support member are connected to said plurality of ribs pivotally connected to said second support member.

18. The wheelchair according to claim 15, wherein said at least one first rib and said at least one second rib each have a longitudinal axis, and the shape of said at least one first rib and the shape of said at least one second rib are uniform along their longitudinal axes.

19. The wheelchair according to claim 15, wherein said at least one first rib and said at least one second rib are manufactured from PVC.

20. The wheelchair according to claim 15, further including a first mounting bracket pivotally and releasably connecting said at least one first rib to said first support member and a second mounting bracket for pivotally and releasably connecting said at least one second rib to said second support member, said first mounting bracket and said second mounting bracket permitting adjustment of said support surface.

* * * * *